United States Patent [19]

Arsenault

[11] 4,379,563

[45] Apr. 12, 1983

[54] AUXILIARY ICE SKATE BLADE

[76] Inventor: Serge Arsenault, 1700 Longueuil, St. Bruno, Quebec, Canada

[21] Appl. No.: 247,125

[22] Filed: Mar. 24, 1981

[51] Int. Cl.[3] ..... A63C 3/00

[52] U.S. Cl. ..... 280/7.1; 280/11.18; 280/12 A; 280/809

[58] Field of Search ..... 280/11.18, 7.13, 11.12, 280/28, 825, 12 A, 7.1, 809

[56] References Cited

U.S. PATENT DOCUMENTS 710,537 10/1902 Stromsen ..... 280/11.18
1,319,094 10/1919 Kerrigan ..... 280/11.12
2,108,128 2/1938 Kinney ..... 280/11.18
2,187,629 1/1940 Rhoades ..... 280/825

FOREIGN PATENT DOCUMENTS 74126 10/1948 Norway ..... 280/11.18

*Primary Examiner*—David M. Mitchell

[57] ABSTRACT

An auxiliary ice skate blade for attachment to the skate blade secured to a skate boot. The auxiliary skate blade comprises a narrow elongated blade having an ice contacting edge and a blade support member secured to an upper part of the elongated blade for detachable securement to the skate blade secured to a boot.

7 Claims, 3 Drawing Figures

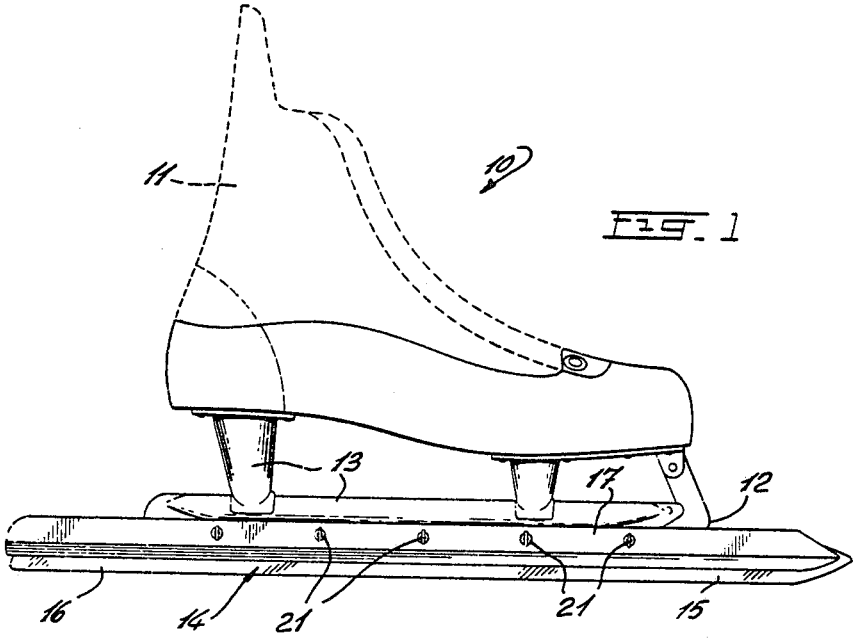
FIG. 1
FIG. 2
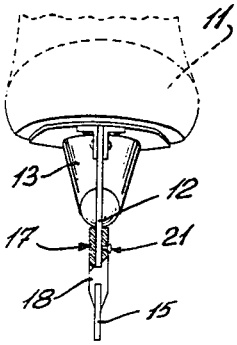
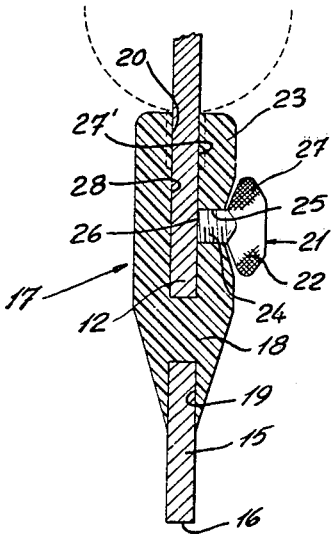
FIG. 3

AUXILIARY ICE SKATE BLADE

BACKGROUND OF THE INVENTION (a) Field of the Invention

The present invention relates to an auxiliary skate blade for attachment to a skate blade already secured to a skate boot, and preferably, but not exclusively, to an auxiliary ice skate blade which is substantially longer than the blade which is secured to the boot.

(b) Description of Prior Art

It is known affix auxiliary devices over an ice skate blade to permit the ice skate to be converted into a shoe lower surface whereby one can walk with the skate blade on floor surfaces or other surfaces without damage to the surface. Also, ski type runner attachment devices are known for securement to the skate blade support to convert the skate blade into a ski surface for displacing oneself on snow.

SUMMARY OF THE INVENTION

The present invention relates to a novel auxiliary skate blade which is attachable to a skate blade already secured to a boot to convert the skate into a different type of skate such as a racing type skate which is popularly utilized as a skate for excursions on lengthy ice surfaces.

A feature of the present invention is to provide an auxiliary skate blade which is easily securable and detachable to a skate blade secured to a skate boot.

Another feature of the present invention is to provide an auxiliary ice skate blade which is light, compact, and easily transportable, economical to manufacture, and easy to use.

According to the above features, from a broad aspect, the present invention provides an auxiliary ice skate blade for attachment to a skate blade secured to a skate boot. The auxiliary skate blade comprises a narrow elongated blade having no ice contacting edge and attachment means in a blade-securing upper part for detachable securement to the skate blade secured to the boot.

BRIEF DESCRIPTION OF THE DRAWINGS

The preferred embodiment of the present invention will now be described with reference to the accompanying drawings in which:

FIG. 1 is a side view of a conventional skate showing the auxiliary ice skate blade secured to the blade thereof.

FIG. 2 is a front view with the auxiliary ice skate blade and the skate blade secured to the boot shown in cross-section, and FIG. 3 is an enlarged cross-section view of the auxiliary skate blade showing how it is attached to a skate blade of a conventional skate.

DESCRIPTION OF PREFERRED EMBODIMENTS

Referring now to the drawings, and particularly to FIG. 1, there is shown an ice skate 10 comprising a boot 11 to which an ice skate blade 12 is secured by a blade support structure 13. The auxiliary ice skate blade 14 of the present invention is herein shown secured to the skate blade 12. The auxiliary skate blade comprises essentially a narrow elongated blade 15 having an ice contacting edge 16 and an attachment means 17 in an upper part of the blade 15 for detachable securement to the skate blade 12.

As herein shown, the auxiliary skate blade 14 is substantially longer than the ice skate blade 12 which is secured to the boot 11 whereby to convert the standard type of hockey ice skate 10 to a racing type skate. The substantially longer length of the auxiliary blade permits one to attain higher speeds when skating and is less tiring and therefore desirable for long skating excursions.

Referring now additionally to FIGS. 2 and 3, there is shown the construction of the attachment means 17. It is constituted by a blade support member 18 which may be formed integral with the narrow elongated blade 15. However, as herein shown, the blade support member 18 is constituted by a molded piece formed of rigid material, such as rigid plastics, aluminum or other suitable materials. The blade support member 18 has a lower blade retention slot 19 for receiving the narrow elongated blade 15 therein. Suitable means is provided to secure the blade 15 within the retention slot 19 and it may be constituted by the use of adhesives, or fasteners extending through the lower part of the support member 18 and the upper part of the blade 15, as is well known in the art.

An upper elongated slot 20 is provided in the upper part of the support member 18 and extends in axial alignment with the blade 15 whereby to receive at least a lower edge portion of the skate blade 12 which is secured to the skate boot 11. Fastening means 21, herein constituted by two or more spaced apart screw-type fasteners 22, are provided in a side wall 23 of the upper part of the blade support member 18 adjacent the slot 20. The screw-type fasteners 22 have a threaded shaft portion 24 in threaded engagement with respective threaded bore 25 extending through the side wall 23. The free end of the threaded shaft 24 constitutes a clamping surface 26. The other end of the threaded shaft portion 24 is provided with a finger gripping outer end 27 to impart rotation and torque to the fastener whereby the clamping surface 26 to each fastener will apply a retention axial force against the side face 27' of the blade 12 which is positioned in the slot 20 to clamp the blade 12 between the inner side wall 28 of the slot 20 and the clamping surfaces 26. Thus, the blade 12 is rigidly and immovably secured in the slot 20.

It is within the ambit of the present invention to provide any obvious modifications of the embodiment described herein, provided such modifications fall within the scope of the appended claims. For example, the inner side wall 28 of the slot 20 may have a rough surface texture or be provided with small vertical ribs therein to provide better friction retention with the side face of the skate blade positioned thereagainst. Also, the fasteners 21 may be of a different construction than screw-type and could be, for example, wedge clamps. Also, the auxiliary blade need not be longer than the conventional blade secured to the skate boot and could serve for the purpose of providing a sharp lower edge to the skate blade secured to the boot when the latter blade contacting edge becomes worn.

I claim:

1. An auxiliary ice skate blade for attachment to a skate blade secured to a skate boot, said auxiliary skate blade comprising a rigid blade support member having a lower blade retention slot, a narrow elongated blade having an ice contacting edge portion and a securable upper end portion retained in said retention slot, and attachment means in said support member for detachable securement of said support member to a skate blade secured to a boot whereby said skate blade and elongated blade are in axial planar alignment.

2. An auxiliary ice skate blade as claimed in claim 1 wherein said attachment means comprises an upper elongated slot in said blade support member for receiving at least a lower edge portion of said skate blade secured to said skate boot, and fastening means to rigidly retain said skate blade of said boot in said slot.

3. An auxiliary ice skate blade as claimed in claim 2 wherein said fastening means comprises two or more spaced apart fastening members secured to said blade support member and having a clamping surface displaceable against a side face of said blade in said slot to rigidly clamp it therein.

4. An auxiliary ice skate blade as claimed in claim 3 wherein said fastening members are screw-type fasteners threaded in a side wall of said blade support member adjacent said slot, said fasteners each having a free end constituting said clamping surface.

5. An auxiliary ice skate blade as claimed in claim 4 wherein said screw-type fasteners are received in threaded bores in said side wall of said blade support member, each fastener having a finger gripping outer end to impart rotation and torque to said fastener whereby said free end of said fastener applies a retention force against said side face of said blade in said slot to clamp said blade between an inner side wall of said elongated slot and said free end of said fasteners.

6. An auxiliary ice skate blade as claimed in claim 1 wherein said blade support member is a molded piece formed of rigid material.

7. An auxiliary ice skate blade as claimed in claim 1 wherein said elongated blade is substantially longer than said blade secured to a skate boot.

* * * * *